US008047389B2

(12) United States Patent
Melrose

(10) Patent No.: US 8,047,389 B2
(45) **Date of Patent: *Nov. 1, 2011**

(54) SEMI-RIGID COLLAPSIBLE CONTAINER

(75) Inventor: David Murray Melrose, Auckland (NZ)

(73) Assignee: CO2 Pac Limited, Auckland (NZ)

( * ) Notice: Subject to any disclaimer, the term of this patent is extended or adjusted under 35 U.S.C. 154(b) by 222 days.

This patent is subject to a terminal disclaimer.

(21) Appl. No.: 11/413,583

(22) Filed: Apr. 28, 2006

(65) Prior Publication Data

US 2006/0243698 A1 Nov. 2, 2006

Related U.S. Application Data

(63) Continuation of application No. 10/363,400, filed on Feb. 26, 2003, now Pat. No. 7,077,279.

(51) Int. Cl.
*B65D 1/02* (2006.01)
*B65D 1/40* (2006.01)

(52) U.S. Cl. ..... 215/381; 215/382; 215/900; 220/666; 220/671

(58) Field of Classification Search ..... 215/381, 215/383, 900, 382; 220/609, 666, 671, 675
See application file for complete search history.

(56) References Cited

U.S. PATENT DOCUMENTS

| | | | |
|---|---|---|---|
| 1,499,239 | A | 6/1924 | Malmquist |
| 2,124,959 | A | 7/1938 | Martin |
| 2,880,902 | A | 4/1959 | Owsen |
| 2,971,671 | A | 2/1961 | Shakman |
| 2,982,440 | A | 5/1961 | Harrison |
| 3,081,002 | A | 3/1963 | Tauschinski et al. |
| 3,174,655 | A | 3/1965 | Hurschman |

(Continued)

FOREIGN PATENT DOCUMENTS

| | | |
|---|---|---|
| DE | 1761753 | 1/1972 |

(Continued)

OTHER PUBLICATIONS

Derwent Abstract Accession No. 97-294279/27. JP 09110045 A (Shintani T) Apr. 28, 1997.

(Continued)

*Primary Examiner* — Sue A Weaver
(74) *Attorney, Agent, or Firm* — Henricks, Slavin & Holmes LLP

(57) ABSTRACT

A semi-rigid collapsible container (10) has a side-wall with an upper portion (5), a central portion (6), a lower portion (7) and a base (8). The central portion (6) includes a vacuum panel portion having a control portion (2) and an initiator portion 1. The control portion (2) is inclined more steeply in a vertical direction, i.e. has a more acute angle relative to the longitudinal axis of the container (10), than the initiator portion 1. On low vacuum force being present within the container panel following the cooling of a hot liquid in the container 10 the initiator portion (1) will flex inwardly to cause the control portion (2) to invert and flex further inwardly into the container (10) and the central portion (6) to collapse. In the collapsed state upper and lower portions of the central portion (6) may be in substantial contact so as to contain the top-loading capacity of the container (10). Raised ribs (3) made an additional support for the container in its collapsed state. In another embodiment the telescoping of the container back to its original position occurs when the vacuum force is released following removal of the container cap.

25 Claims, 5 Drawing Sheets

U.S. PATENT DOCUMENTS

| | | | | | |
|---|---|---|---|---|---|
| 3,301,293 | A | | 1/1967 | Santelli | 220/666 |
| 3,409,167 | A | * | 11/1968 | Blanchard | 220/609 |
| 3,426,939 | A | | 2/1969 | Young | |
| 3,483,908 | A | | 12/1969 | Donovan | |
| 3,704,140 | A | | 11/1972 | Petit et al. | |
| 3,819,789 | A | | 6/1974 | Parker | |
| 3,904,069 | A | | 9/1975 | Toukmanian | |
| 4,134,510 | A | | 1/1979 | Chang | |
| 4,219,137 | A | | 8/1980 | Hutchens | |
| 4,247,012 | A | | 1/1981 | Alberghini | |
| 4,338,765 | A | | 7/1982 | Ohmori et al. | |
| 4,377,191 | A | | 3/1983 | Yamaguchi | |
| 4,381,061 | A | | 4/1983 | Cerny et al. | 215/1 C |
| 4,444,308 | A | | 4/1984 | MacEwen | |
| 4,492,313 | A | | 1/1985 | Touzani | |
| 4,497,855 | A | | 2/1985 | Agrawal | |
| 4,542,029 | A | | 9/1985 | Caner et al. | |
| 4,610,366 | A | | 9/1986 | Estes et al. | 426/106 |
| 4,642,968 | A | | 2/1987 | McHenry et al. | |
| 4,645,078 | A | | 2/1987 | Reyner | 206/524.8 |
| 4,667,454 | A | | 5/1987 | McHenry et al. | |
| 4,685,273 | A | | 8/1987 | Caner et al. | |
| 4,749,092 | A | | 6/1988 | Sugiura et al. | |
| 4,773,458 | A | | 9/1988 | Touzani | 220/666 |
| 4,813,556 | A | * | 3/1989 | Lawrence | 215/11.3 |
| 4,836,398 | A | | 6/1989 | Leftault, Jr. et al. | |
| 4,865,206 | A | | 9/1989 | Behm et al. | |
| 4,887,730 | A | | 12/1989 | Touzani | 215/271 |
| 4,921,147 | A | | 5/1990 | Poirier | 222/527 |
| 4,967,538 | A | * | 11/1990 | Leftault et al. | 53/440 |
| 4,978,015 | A | | 12/1990 | Walker | |
| 5,005,716 | A | | 4/1991 | Eberle | |
| 5,060,453 | A | | 10/1991 | Alberghini et al. | |
| 5,141,121 | A | | 8/1992 | Brown et al. | |
| 5,199,587 | A | | 4/1993 | Ota et al. | |
| 5,199,588 | A | | 4/1993 | Hayashi | |
| 5,201,438 | A | | 4/1993 | Norwood | 220/666 |
| 5,217,737 | A | | 6/1993 | Gygax et al. | |
| 5,333,761 | A | | 8/1994 | Davis et al. | |
| 5,341,946 | A | | 8/1994 | Vailliencourt | |
| 5,454,481 | A | | 10/1995 | Hsu | |
| 5,472,105 | A | | 12/1995 | Krishnakumar et al. | |
| RE35,140 | E | | 1/1996 | Powers, Jr. | |
| 5,632,397 | A | | 5/1997 | Fandeux et al. | 215/382 |
| 5,642,826 | A | | 7/1997 | Melrose | |
| 5,704,504 | A | | 1/1998 | Bueno | |
| 5,730,314 | A | * | 3/1998 | Wiemann et al. | 220/609 |
| 5,758,802 | A | | 6/1998 | Wallays | |
| 5,762,221 | A | | 6/1998 | Tobias et al. | |
| 5,860,556 | A | | 1/1999 | Robbins, III | |
| 5,908,128 | A | | 6/1999 | Krishnakumar et al. | |
| RE36,639 | E | | 4/2000 | Okhai | |
| 6,077,554 | A | | 6/2000 | Wiemann et al. | |
| 6,105,815 | A | | 8/2000 | Mazda | 220/666 |
| 6,595,380 | B2 | | 7/2003 | Silvers | |
| 6,612,451 | B2 | | 9/2003 | Tobias et al. | |
| 6,763,968 | B1 | | 7/2004 | Boyd et al. | |
| 6,769,561 | B2 | | 8/2004 | Futral et al. | |
| 6,779,673 | B2 | | 8/2004 | Melrose | |
| 6,935,525 | B2 | | 8/2005 | Trude | |
| 6,983,858 | B2 | | 1/2006 | Slat et al. | |
| 7,077,279 | B2 | * | 7/2006 | Melrose | 215/381 |
| 7,150,372 | B2 | | 12/2006 | Lisch et al. | |
| 7,159,374 | B2 | | 1/2007 | Abercrombie, III et al. | |
| 7,520,400 | B2 | | 4/2009 | Young et al. | |
| 7,717,282 | B2 | | 5/2010 | Melrose | |
| 2002/0000421 | A1 | | 1/2002 | Ota et al. | |
| 2002/0096486 | A1 | | 7/2002 | Bourgue et al. | |
| 2002/0158038 | A1 | | 10/2002 | Heisel et al. | |
| 2003/0015491 | A1 | | 1/2003 | Melrose | |
| 2003/0173327 | A1 | | 9/2003 | Melrose | |
| 2004/0016716 | A1 | | 1/2004 | Melrose | |
| 2004/0074864 | A1 | | 4/2004 | Melrose | |
| 2006/0138074 | A1 | | 6/2006 | Melrose | |
| 2006/0231985 | A1 | | 10/2006 | Kelley | |
| 2006/0243698 | A1 | | 11/2006 | Melrose | |
| 2006/0255005 | A1 | | 11/2006 | Melrose et al. | |
| 2006/0261031 | A1 | | 11/2006 | Melrose | |
| 2007/0017892 | A1 | | 1/2007 | Melrose | |
| 2007/0045312 | A1 | | 3/2007 | Abercrombie et al. | |
| 2007/0051073 | A1 | | 3/2007 | Kelley et al. | |
| 2007/0084821 | A1 | | 4/2007 | Bysick et al. | |
| 2007/0125743 | A1 | | 6/2007 | Pritchett et al. | |
| 2007/0199915 | A1 | | 8/2007 | Denner et al. | |
| 2007/0199916 | A1 | | 8/2007 | Denner et al. | |
| 2007/0215571 | A1 | | 9/2007 | Trude | |
| 2008/0047964 | A1 | | 2/2008 | Denner et al. | |
| 2008/0298938 | A1 | | 12/2008 | Melrose | |

FOREIGN PATENT DOCUMENTS

| | | | | |
|---|---|---|---|---|
| DE | 2102319 | | | 8/1972 |
| DE | 3215866 | | | 11/1983 |
| EP | 0521642 | | | 1/1993 |
| EP | 0666222 | | | 8/1995 |
| EP | 0666222 | A1 | * | 8/1995 |
| FR | 2607109 | A1 | | 5/1998 |
| GB | 781103 | | | 8/1957 |
| GB | 2372977 | | | 9/2002 |
| JP | 63-189224 | | | 8/1988 |
| JP | 06-336238 | | | 12/1994 |
| JP | 8-53115 | | * | 2/1996 |
| JP | 8253220 | | | 10/1996 |
| JP | 9110045 | | | 4/1997 |
| JP | 10-167226 | | | 6/1998 |
| JP | 10-230919 | | | 9/1998 |
| JP | 2000-168756 | | * | 6/2000 |
| JP | 2000229615 | | | 8/2000 |
| NZ | 296014 | | | 10/1998 |
| NZ | 335565 | | | 10/1999 |
| WO | WO93/09031 | | | 5/1993 |
| WO | WO93/12975 | | | 7/1993 |
| WO | WO 9405555 | A1 | | 3/1994 |
| WO | WO 9703885 | | | 2/1997 |
| WO | WO97/14617 | | | 4/1997 |

OTHER PUBLICATIONS

Derwent Abstract Accession No. 96-493250/49. JP 08253220 A (Morishita Roussel KK).

Derwent Abstract Accession No. 95-057240. JP 06336238 A (Mitsubishi Plastics Ind. Ltd.).

USPTO Serial No. 11/432,715, Melrose US File History as of Nov. 21, 2009.

USPTO Serial No. 11/704,318, Denner et al. US File History as of Sep. 18, 2009.

WIPO, Search Report, in Melrose PCT/NZ01/00176 Application, published Mar. 7, 2002, with WO02/18213.

Takano Tadashi, Container For Liquid, Feb. 27, 1996, Patents Abstracts of Japan.*

Sekisui Seikei Ltd, Compact Below Container Having Bellows, Jun. 20, 2000, Patents Abstracts of Japan.*

* cited by examiner

SEMI-RIGID COLLAPSIBLE CONTAINER

This is a continuation of U.S. patent application Ser. No. 10/363,400, entitled "Semi-Rigid Collapsible Container", filed Feb. 26, 2003, now U.S. Pat. No. 7,077,279 which is a Section 371 application of PCT/NZ01/00176, which is related to New Zealand patent application entitled, "Semi-Rigid Collapsible Container", filed on Aug. 31, 2000, Application No. 506684; and New Zealand application entitled, "Semi-Rigid Collapsible Container", filed on Jun. 15, 2001, Application No. 512423, which are fully incorporated herein by reference and claims priority therefrom.

BACKGROUND TO INVENTION

This invention relates to polyester containers, particularly semi-rigid collapsible containers capable of being filled with hot liquid, and more particularly to an improved construction for initiating collapse in such containers. The invention also relates to such containers capable of being filled with hot liquid.

'Hot-Fill' applications impose significant mechanical stress on a container structure. The thin side-wall construction of a conventional container deforms or collapses as the internal container pressure falls following capping because of the subsequent cooling of the liquid contents. Various methods have been devised to sustain such internal pressure change while maintaining a controlled configuration.

Generally, the polyester must be heat-treated to induce molecular changes resulting in a container that exhibits thermal stability. In addition, the structure of the container must be designed to allow sections, or panels, to 'flex' inwardly to vent the internal vacuum and so prevent excess force being applied to the container structure. The amount of 'flex' available in each panel is limited, however, and as the limit is reached the force is transferred to the side-wall, and in particular the areas between the panels, of the container causing them to fail under any increased load.

Additionally, vacuum force is required in order to flex the panels inwardly to accomplish pressure stabilisation. Therefore, even if the panels are designed to be extremely flexible and efficient, force will still be exerted on the container structure to some degree. The more force that is exerted results in a demand for increased container wall-thickness, which in turn results in increased container cost.

The principal mode of failure in all prior art known to the applicant is non-recoverable buckling, due to weakness in the structural geometry of the container, when the weight of the container is lowered for commercial advantage. Many attempts to solve this problem have been directed to adding reinforcements to the container side-wall or to the panels themselves, and also to providing panel shapes that flex at lower thresholds of vacuum pressure.

To date, only containers utilising vertically oriented vacuum flex panels have been commercially presented and successful In our New Zealand Patent 240448 entitled "Collapsible Container", a semi-rigid collapsible container is described and claimed in which controlled collapsing is achieved by a plurality of arced panels which are able to resist expansion from internal pressure, but are able to expand transversely to enable collapsing of a folding portion under a longitudinal collapsing force. Much prior art in collapsible containers was disclosed, most of which provided for a bellows-like, or accordion-like vertical collapsing of the container.

Such accordion-like structures are inherently unsuitable for hot-fill applications, as they exhibit difficulty in maintaining container stability under compressive load. Such containers flex their sidewalls away from the central longitudinal axis of the container. Further, labels cannot be properly applied over such sections due to the vertical movement that takes place. This results in severe label distortion. For successful label application, the surface underneath must be structurally stable, as found in much prior art cold-fill container sidewalls whereby corrugations are provided for increased shape retention of the container under compressive load. Such compressive load could be supplied by either increased top-load or increased vacuum pressure generated within a hot-fill container for example.

OBJECTS OF THE INVENTION

It is an object of the invention to provide a semi-rigid container which is able to more efficiently compensate for vacuum pressure in the container and to overcome or at least ameliate problems with prior art proposals to date and/or to at least provide the public with a useful choice.

SUMMARY OF THE INVENTION

According to one aspect of this invention there is provided a semi-rigid container, a side wall of which has at least one substantially vertically folding vacuum panel portion including an initiator portion and a control portion which resists being expanded from the collapsed state.

Preferably the vacuum panel is adapted to fold inwardly under an externally applied mechanical force in order to completely remove vacuum pressure generated by the cooling of the liquid contents, and to prevent expansion from the collapsed state when the container is uncapped.

According to a further aspect of this invention there is provided a semi-rigid container, a side wall of which has a substantially vertically folding vacuum panel portion including an initiator portion which provides for expansion from the collapsed state.

Preferably the vacuum panel is adapted to fold inwardly under a vacuum force below a predetermined level and to enable expansion from the collapsed state when the container is uncapped and vacuum released.

Further aspects of this invention, which should be considered in all its novel aspects, will become apparent from the following description.

DESCRIPTION OF PREFERRED EMBODIMENTS

Figure 1:
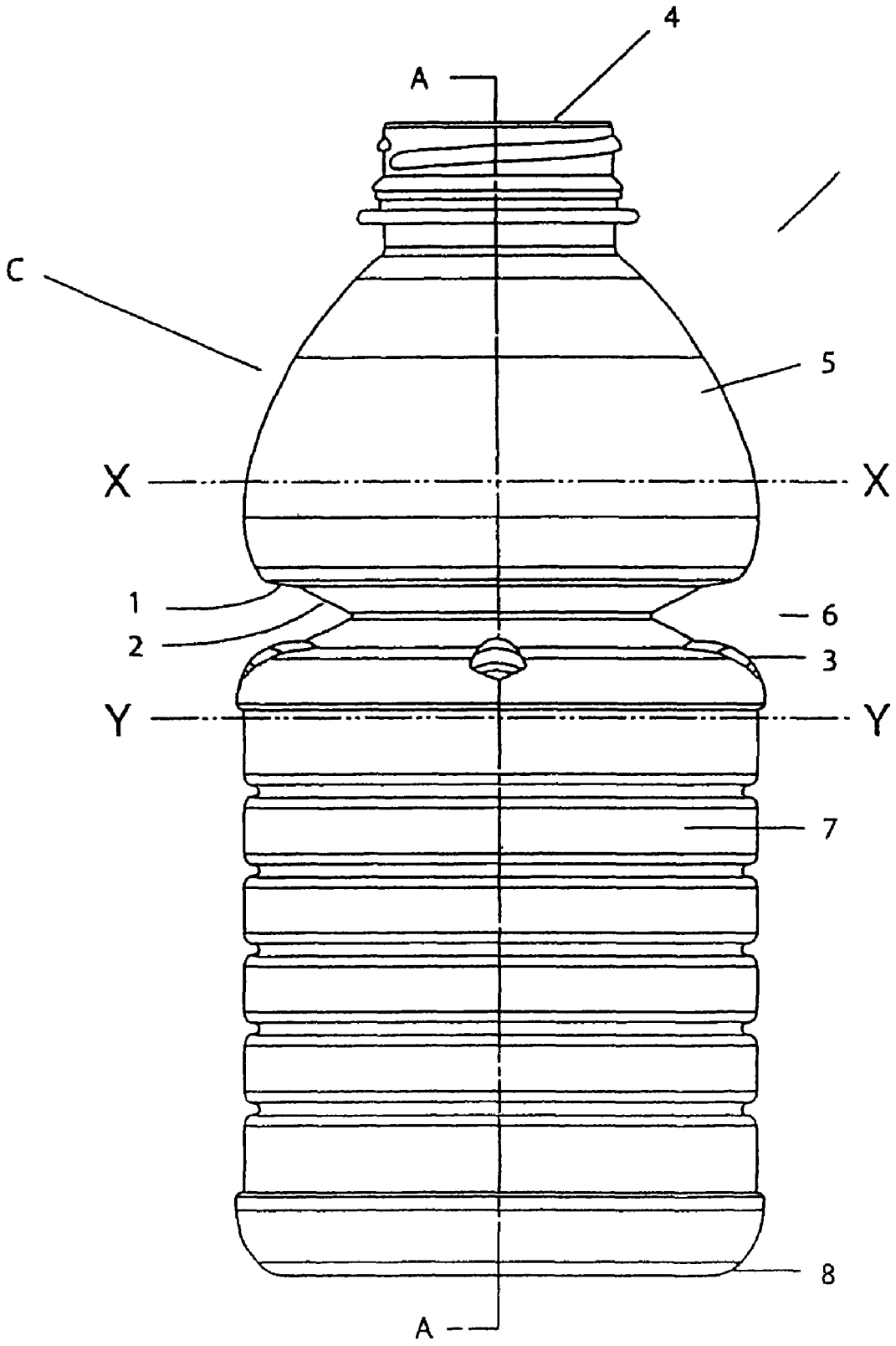
FIG. 1: shows diagrammatically an enlarged view of a semi-rigid collapsible container according to one possible embodiment of the invention in its pre-collapsed condition.
Figure 4:
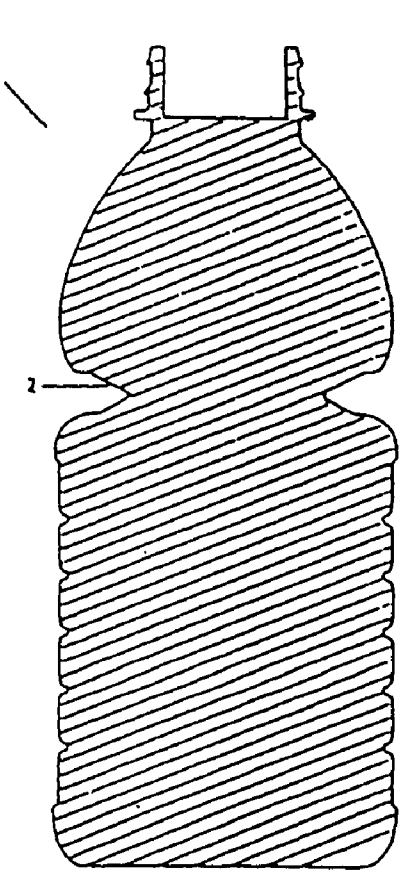
FIG. 4: shows the container of FIG. 1 along arrows A-A.

The present invention relates to collapsible semi-rigid containers having a side-wall with at least one substantially vertically folding vacuum panel section which compensates for vacuum pressure within the container.

Preferably in one embodiment the flexing may be inwardly from an applied mechanical force. By calculating the amount of volume reduction that is required to negate the effects of vacuum pressure that would normally occur when the hot liquid cools inside the container, a vertically folding portion can be configured to allow completely for this volume reduction within itself. By mechanically folding the portion down after hot filling, there is complete removal of any vacuum force generated inside the container during liquid cooling. As there is no resulting vacuum pressure remaining inside the cooled container, there is little or no force generated against the sidewall, causing less stress to be applied to the container sidewalls than in prior art.

Further, by configuring the control portion to have a steep angle, expansion from the collapsed state when the container is uncapped is also prevented. A large amount of force, equivalent to that mechanically applied initially, would be required to revert the control portion to its previous position. This ready evacuation of volume with negation of internal vacuum force is quite unlike prior art vacuum panel container performance.

The present invention may be a container of any required shape or size and made from any suitable material and by any suitable technique. However, a plastics container blow moulded from polyethylene tetraphalate (PET) may be particularly preferred.

One possible design of semi-rigid container is shown in FIGS. 1 to 4 of the accompanying drawings. The container referenced generally by arrow 1 is shown with an open neck portion 4 leading to a bulbous upper portion 5, a central portion 6, a lower portion 7 and a base 8.

The central portion 6 provides a vacuum panel portion which will fold substantially vertically to compensate for vacuum pressure in the container 10 following cooling of the hot liquid.

The vacuum panel portion has an initiator portion 1 capable of flexing inwardly under low vacuum force and causes a more vertically steeply inclined (a more acute angle relative to the longitudinal axis of the container 10), control portion 2 to invert and flex further inwardly into the container 10.

The provision of an initiator portion 1 allows for a steep, relative to the longitudinal, angle to be utilised in the control portion 2. Without an initiator portion 1, the level of force needed to invert the control portion 2 may be undesirably raised. This enables strong resistance to expansion from the collapsed state of the bottle 1. Further, without an initiator portion to initiate inversion of the control portion, the control portion may be subject to undesirable buckling under compressive vertical load. Such buckling could result in failure of the control portion to fold into itself satisfactorily. Far greater evacuation is therefore generated from a single panel section than from prior art vacuum panels. Vacuum pressure is subsequently reduced to a greater degree than prior art proposals causing less stress to be applied to the container side walls.

Moreover, when the vacuum pressure is adjusted following application of a cap to the neck portion 4 of the container 10 and subsequent cooling of the container contents, it is possible for the collapsing section to cause ambient or even raised pressure conditions inside the container 10.

This increased venting of vacuum pressure provides advantageously for less force to be transmitted to the side walls of the container 10. This allows for less material to be necessarily utilised in the construction of the container 10 making production cheaper. This also allows for less failure under load of the container 10, and there is much less requirement for panel area to be necessarily deployed in a design of a hot fill container, such as container 10. Consequently, this allows for the provision of other more aesthetically pleasing designs to be employed in container design for hot fill applications. For example, shapes could be employed that would otherwise suffer detrimentally from the effects of vacuum pressure. Additionally, it would be possible to fully support the label application area, instead of having a 'crinkle' area underneath which is present with the voids provided by prior art containers utilising vertically oriented vacuum flex panels.

Figure 3:
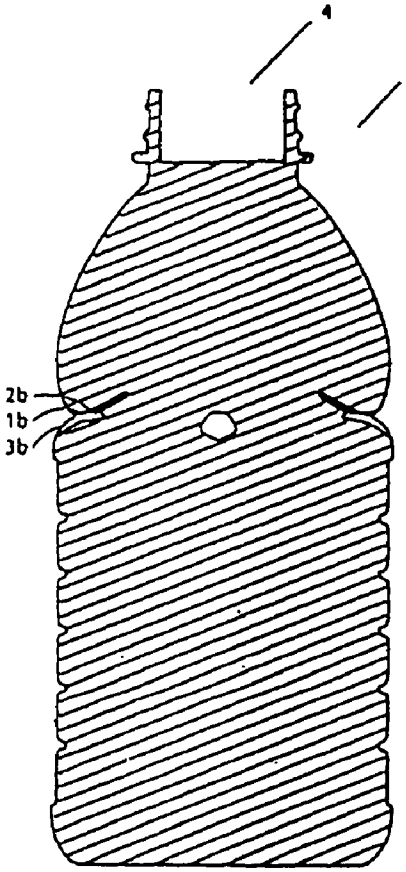
FIG. 3: very diagrammatically shows a cross-sectional view of the container of FIG. 2 along the arrows A-A.
Figure 2:
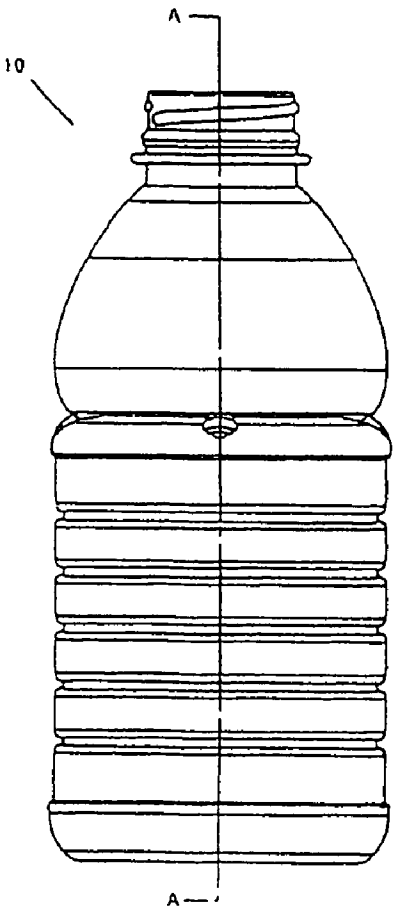
FIG. 2: shows the container of FIG. 1 in its collapsed condition.

In a particular embodiment of the present invention, support structures 3, such as raised radial ribs as shown, may be provided around the central portion 6 so that, as seen particularly in FIGS. 2 and 3, with the initiator portion 1 and the control portion 2 collapsed, they may ultimately rest in close association and substantial contact with the support structures 3 in order to maintain or contribute to top-load capabilities, as shown at 1*b* and 2*b* and 3*b* in FIG. 3.

Figure 9A:
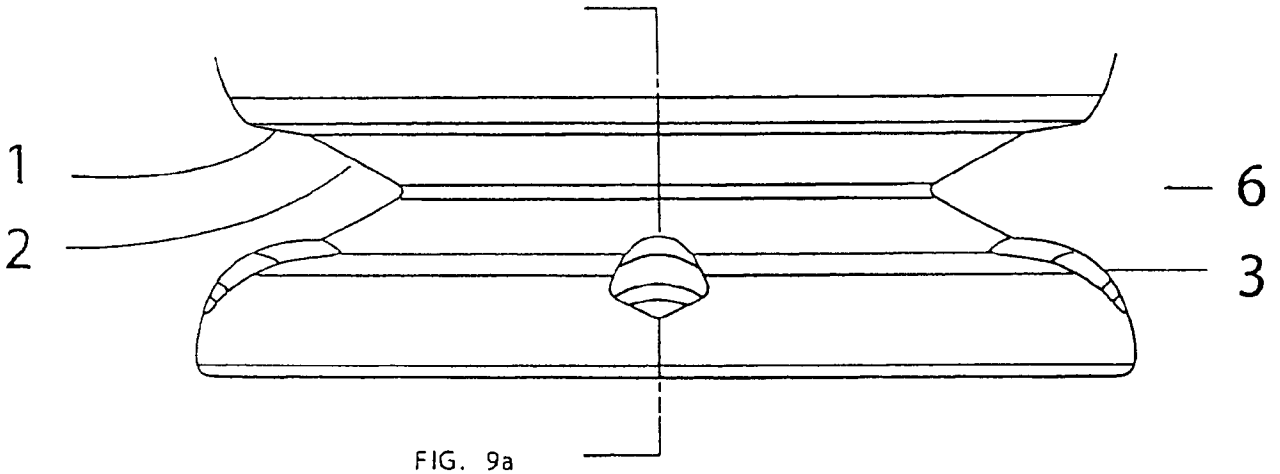
FIGS. 9*a* and 9*b*: Show expanded views of the section between lines X-X and Y-Y of the container of FIG. 1 in its pre-collapsed and collapsed conditions respectively.
Figure 9B:
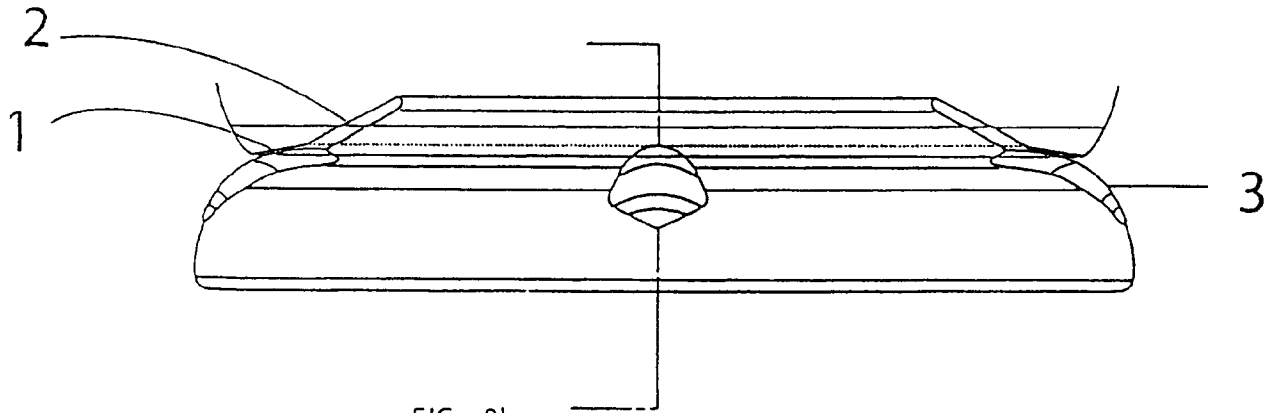

In the expanded views of FIGS. 9*a* and 9*b*, the steeper angle of the initiator portion 1 relative to the angle of the control portion 2 is indicated, as is the substantial contact of the support structures 3 with the central portion 6 after it has collapsed.

Figure 10A:
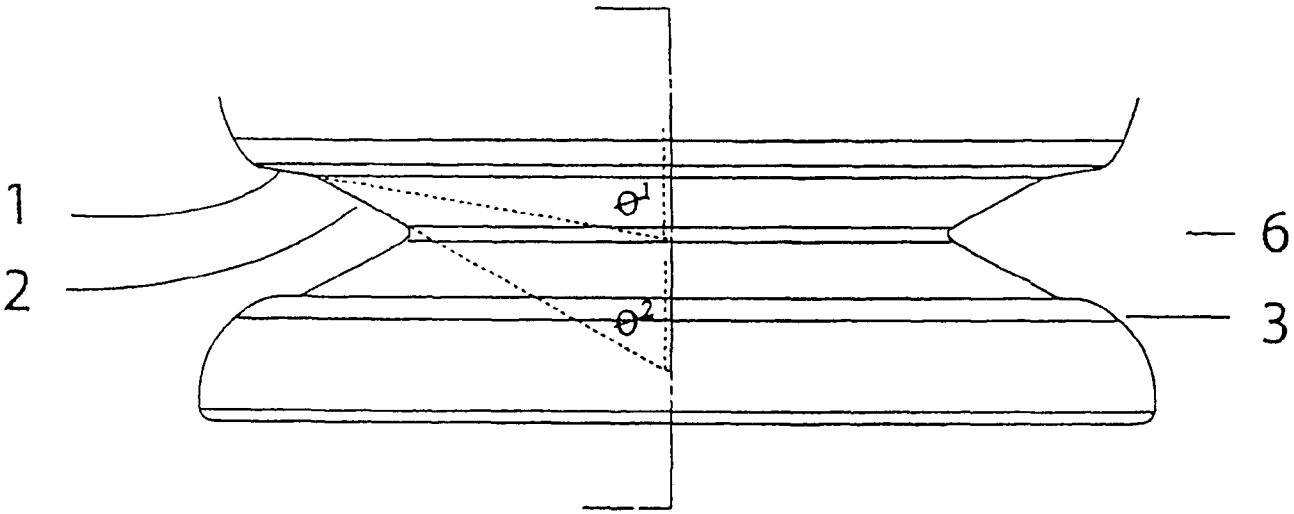
FIGS. 10*a* and 10*b*: Show expanded views of the same section of the container of FIG. 1 in its pre-collapsed and collapsed conditions respectively but with the ribs 3 omitted.
Figure 10B:
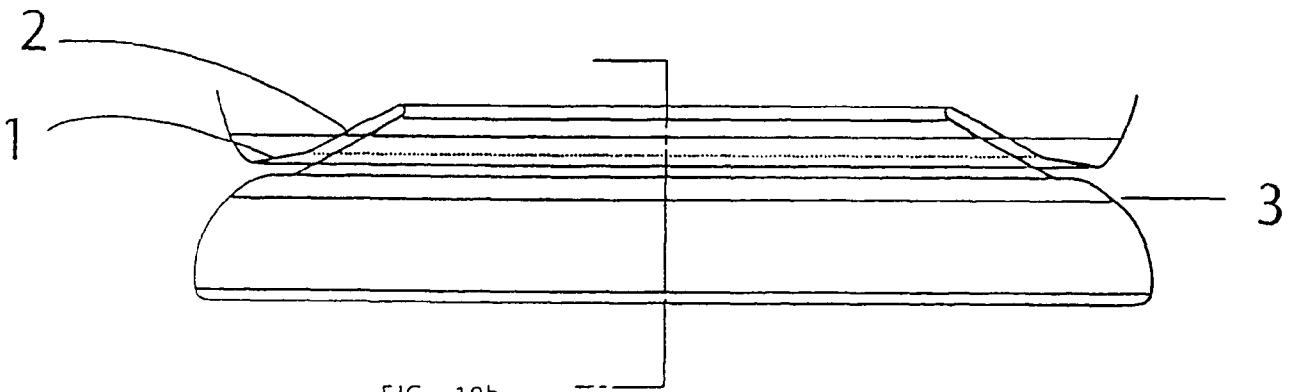

In the expanded views of FIGS. 10*a* and 10*b*, the support structures 3 have been omitted, as in the embodiment of FIG. 5 described later. Also the central portion 6 illustrates the steeper $\theta^1$ of the initiator portion 1 relative to the $\theta^2$ of the control portion 2 and also the positioning of the vacuum panel following its collapse but without the support structures or ribs 3.

In a further embodiment a telescopic vacuum panel is capable of flexing inwardly under low vacuum force, and enables expansion from the collapsed state when the container is uncapped and the vacuum released.

Preferably in one embodiment the initiator portion is configured to provide for inward flexing under low vacuum force. The control portion is configured to allow for vacuum compensation appropriate to the container size, such that vacuum force is maintained, but kept relatively low, and only sufficient to draw the vertically folding vacuum panel section down until further vacuum compensation is not required. This will enable expansion from the collapsed state when the container is uncapped and vacuum released. Without the low vacuum force pulling the vertically folding vacuum panel section down, it will reverse in direction immediately due to the forces generated by the memory in the plastic material. This provides for a 'tamper-evident' feature for the consumer, allowing as it does for visual confirmation that the product has not been opened previously.

Additionally, the vertically folding vacuum panel section may employ two opposing initiator portions and two opposing control portions. Reducing the degree of flex required from each control portion subsequently reduces vacuum pressure to a greater degree. This is achieved through employing two control portions, each required to vent only half the amount of vacuum force normally required of a single portion. Vacuum pressure is subsequently reduced more than from prior art vacuum flex panels, which are not easily configured to provide such a volume of ready inward movement. Again, less stress is applied to the container side-walls.

Moreover, when the vacuum pressure is adjusted following application of the cap to the container, and subsequent cooling of the contents, top load capacity for the container is maintained through side-wall contact occurring through complete vertical collapse of the vacuum panel section.

Still, further, the telescopic panel provides good annular strengthening to the package when opened.

Referring now to FIGS. 5 to 8 of the drawings, preferably in this embodiment there are two opposing initiator portions, upper initiator portion 103 and lower initiator portion 105, and two opposing control portions provided, upper control portion 104 and lower control portion 106. When the vacuum pressure is adjusted following application of a cap (not shown) to the container 100, and subsequent cooling of the contents, top load capacity for the container 100 is maintained through upper side-wall 200 and lower side-wall 300 contact occurring through complete or substantially complete vertical collapse of the vacuum panel section 101, see FIGS. 6 and 7.

This increased venting of vacuum pressure provides advantageously for less force to be transmitted to the side-walls 100 and 300 of the container 100. This allows for less material to be necessarily utilised in the container construction, making production cheaper.

This allows for less failure under load of the container 100 and there is no longer any requirement for vertically oriented panel area to be necessarily deployed in the design of hot-fill containers. Consequently, this allows for the provision of other more aesthetically pleasing designs to be employed in container design for hot-fill applications. Further, this allows for a label to be fully supported by total contact with a side-wall which allows for more rapid and accurate label applications.

Figures 5, 6, 7, 8:
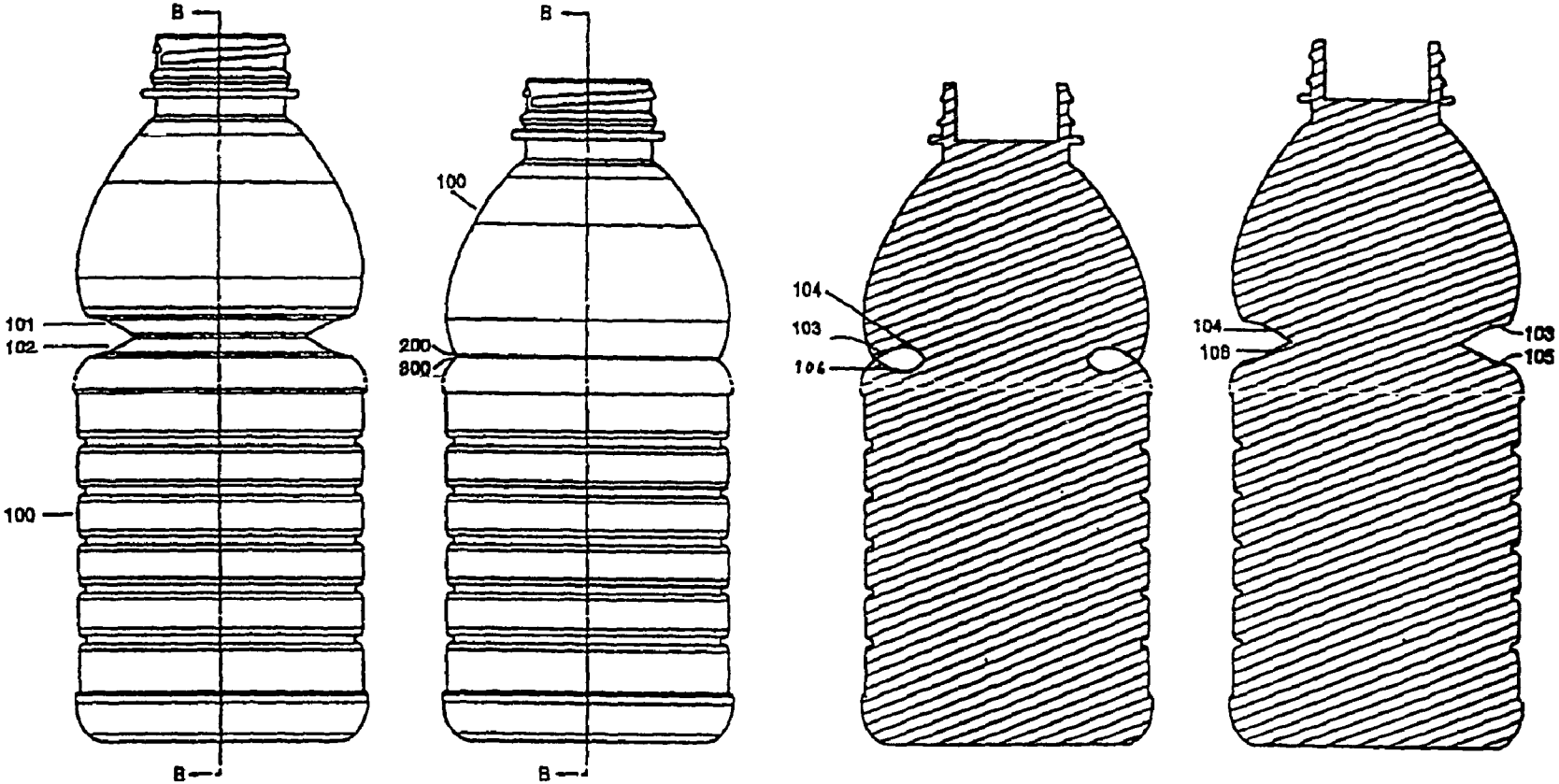
FIG. 5: shows a container according to a further possible embodiment of the invention.
FIG. 6: shows the container of FIG. 5 after collapse.
FIG. 7: shows a cross-sectional view of the container of FIG. 6 along arrows B-B.
FIG. 8: shows a cross-sectional view of the container of FIG. 5 along arrows B-B.

Additionally, when the cap is released from a vacuum filled container that employs two opposing collapsing sections, each control portion 104, 106 as seen in FIG. 7, is held in a flexed position and will immediately telescope back to its original position, as seen in FIG. 8. There is immediately a larger headspace in the container which not only aids in pouring of the contents, but prevents 'blow-back' of the contents, or spillage upon first opening.

Further embodiments of the present invention may allow for a telescopic vacuum panel to be depressed prior to, or during, the filling process for certain contents that will subsequently develop internal pressure before cooling and requiring vacuum compensation. In this embodiment the panel is compressed vertically, thereby providing for vertical telescopic enlargement during the internal pressure phase to prevent forces being transferred to the side-walls, and then the panel is able to collapse again telescopically to allow for subsequent vacuum compensation.

Still, further, the telescopic panel provides good annular strengthening to the package when opened.

Although two panel portions 101 and 102 are shown in the drawings it is envisaged that less than two may be utilized.

Where in the foregoing description, reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

The invention claimed is:

1. A container suitable for containing a hot liquid having a longitudinal axis and at least one substantially vertically folding panel portion, which compensates for pressure change within the container, the panel portion being substantially transversely disposed relative to the longitudinal axis, and the panel portion including an initiator portion and a control portion, wherein the initiator portion initiates flexing of the control portion and the panel portion flexes and inverts in a direction substantially parallel with the longitudinal axis, under a longitudinally applied force, wherein the control portion has a more acute angle than the initiator portion relative to the longitudinal axis of the container.

2. A container according to claim 1, wherein the longitudinally applied force is an externally applied mechanical force substantially parallel with said longitudinal axis.

3. A container according to claim 1, wherein a sidewall of the container includes a label application area that is structurally stable.

4. A container according to claim 1, wherein the panel portion flexes and inverts when the longitudinally applied force is above a predetermined level.

5. A container according to claim 1, wherein after inversion the panel portion flexes back when the internal pressure of the container increases.

6. A container according to claim 1, wherein the panel portion is provided between an upper portion and a lower portion of a side wall.

7. A container according to claim 6, wherein when the panel portion is inverted, upper and lower portions of the side wall are adapted to be in substantial contact.

8. A container according to claim 7, wherein the container includes a plurality of spaced apart supporting ribs adapted to be in substantial contact with the panel portion when the panel portion is inverted to contribute to maintenance of topload capabilities of the container.

9. A container according to claim 1, wherein the flexing of the initiator portion causes the control portion to invert and flex inwardly into the container.

10. A container according to claim 1, wherein after inversion the panel portion flexes back when the longitudinally applied force is removed.

11. A container according to claim 1, wherein the panel portion is configured whereby inversion of the panel portion when the container is closed results in an increase in internal pressure within the container.

12. A container according to claim 1, wherein the panel portion is configured such that after inversion the panel portion flexes back following release of the pressure within the container when the container is opened.

13. A container as claimed in claim 1, having more than one panel portion.

14. A container as claimed in claim 13, wherein the panel portion includes two initiator portions and two control portions.

15. A container suitable for containing a heated liquid and having a longitudinal axis and with at least one substantially vertically folding pressure panel portion to compensate for pressure change within the container caused by a heating or cooling of a liquid contained within the container when the container is closed, wherein the pressure panel portion is substantially transversely disposed relative to the longitudinal axis, wherein the pressure panel portion includes an initiator portion and a control portion, said control portion having a maximum acute angle relative to the longitudinal axis of the container and said initiator portion having a minimum acute angle relative to the longitudinal axis of the container and wherein the initiator portion causes said control portion to flex inwardly into the container and the pressure panel portion inverts vertically substantially parallel with said longitudinal axis.

16. A container for containing a heated liquid and having a longitudinal axis and with at least one substantially vertically folding pressure panel portion to compensate for pressure change within the container, wherein the pressure panel portion is substantially transversely disposed relative to the longitudinal axis, said pressure panel portion includes an initiator portion and a control portion said initiator portion disposed nearer a side wall and further from said longitudinal axis than said control portion, and wherein the panel portion inverts vertically under a pressure force substantially parallel with said longitudinal axis.

17. A container suitable for containing a hot liquid having a longitudinal axis and at least one substantially vertically folding panel portion, which compensates for pressure change within the container, the panel portion being substantially transversely disposed relative to the longitudinal axis, and the panel portion including an initiator portion and a control portion, wherein the initiator portion initiates flexing of the control portion and the panel portion flexes and inverts in a direction substantially parallel with the longitudinal axis, under a longitudinally applied force, wherein the longitudinally applied force is generated by a pressure change within the container.

18. A container suitable for containing a hot liquid having a longitudinal axis and at least one substantially vertically folding panel portion, which compensates for pressure change within the container, the panel portion being substantially transversely disposed relative to the longitudinal axis, and the panel portion including an initiator portion and a control portion, wherein the initiator portion initiates flexing of the control portion and the panel portion flexes and inverts in a direction substantially parallel with the longitudinal axis, under a longitudinally applied force, and wherein the panel portion resists being flexed back after inversion.

19. A container suitable for containing a hot liquid having a longitudinal axis and at least one substantially vertically folding panel portion, which compensates for pressure change within the container, the panel portion being substantially transversely disposed relative to the longitudinal axis, and the panel portion including an initiator portion and a control portion, wherein the initiator portion initiates flexing of the control portion and the panel portion flexes and inverts in a direction substantially parallel with the longitudinal axis, under a longitudinally applied force, and wherein the control portion is located between the longitudinal axis and the initiator portion.

20. A container suitable for containing a hot liquid having a longitudinal axis and at least one substantially vertically folding panel portion, which compensates for pressure change within the container, the panel portion being substantially transversely disposed relative to the longitudinal axis, and the panel portion including an initiator portion and a control portion, wherein the initiator portion initiates flexing of the control portion and the panel portion flexes and inverts in a direction substantially parallel with the longitudinal axis, under a longitudinally applied force, wherein the panel portion is configured such that the panel portion is moved to the inverted position and held in the inverted position prior to or during filling of the container with a liquid.

21. A container suitable for containing a hot liquid having a longitudinal axis and at least one substantially vertically folding panel portion, which compensates for pressure change within the container, the panel portion being substantially transversely disposed relative to the longitudinal axis, and the panel portion including an initiator portion and a control portion, wherein the initiator portion initiates flexing of the control portion and the panel portion flexes and inverts in a direction substantially parallel with the longitudinal axis, under a longitudinally applied force, wherein the panel portion compensates for pressure change within the container when the container is closed.

22. A container according to claim 21, wherein the panel portion is configured to flex and invert in order to compensate for pressure change within the container that may occur with heating or cooling of a liquid within the container when the container is closed.

23. A container according to claim 22, wherein when a heated liquid within the container is allowed to cool after closure of the container, such that the pressure within the container reduces, the panel portion is configured to flex and invert under the reduced pressure to relieve the pressure reduction.

24. A container according to claim 23, wherein the panel portion is configured such that the flexing and inversion of the panel portion results in substantially all the pressure reduction being relieved.

25. A container according to claim 21, wherein when the container is filled with a liquid, the container is capped and the liquid is heated such that there is an increase in pressure within the container, the panel portion is configured such that the panel portion moves to the inverted position to relieve the increase in pressure and the panel portion moves back to its original position to compensate for pressure reduction as a result of cooling of the liquid.

* * * * *